United States Patent [19]

Odbert

[11] Patent Number: 4,940,424

[45] Date of Patent: Jul. 10, 1990

[54] ELECTRICAL PLUG ACCESSORY

[76] Inventor: Larry E. Odbert, 11179 Jackson Rd., Sacramento, Calif. 95830

[21] Appl. No.: 348,194

[22] Filed: May 5, 1989

[51] Int. Cl.[5] ..... H01R 13/62

[52] U.S. Cl. ..... 439/369; 439/314; 439/367

[58] Field of Search ..... 439/133, 134, 147, 314, 439/318, 367, 368, 369, 370

[56] References Cited

U.S. PATENT DOCUMENTS

| | | | |
|---|---|---|---|
| 1,510,977 | 10/1924 | Clark | 439/369 |
| 3,014,194 | 12/1961 | Berglund | 439/369 |
| 3,030,601 | 4/1962 | Krebs | 439/369 |
| 3,383,639 | 5/1966 | Anderson | 439/369 |
| 4,169,643 | 10/1979 | Gallagher | 439/369 |
| 4,531,800 | 7/1985 | Avener | 439/369 X |
| 4,643,505 | 2/1987 | House et al. | 439/369 |
| 4,690,476 | 9/1987 | Morgenrath | 439/502 |
| 4,721,475 | 1/1988 | Burke, Jr. | 439/133 |
| 4,784,612 | 11/1988 | Ryan | 439/367 |

OTHER PUBLICATIONS

Waxman Industries Advertisement, "National Home Center News", (Dec. 12, 1988), p. 7.

*Primary Examiner*—Neil Abrams
*Assistant Examiner*—Khiem Nguyen
*Attorney, Agent, or Firm*—Irell & Manella

[57] ABSTRACT

A device is provided for holding together male and female electrical plugs. The device has two members, one surrounding the male plug and one surrounding the female plug. The two members are cylindrical and engage one another with protuberances on one member sliding and latching in grooves in the other.

5 Claims, 1 Drawing Sheet

ELECTRICAL PLUG ACCESSORY

BACKGROUND OF THE INVENTION

1. Field of the Invention

This invention relates to improved connection between electrical cords. More particularly, it relates to an accessory for holding two electrical cords in connection and preventing their accidental disconnection.

2. Description of Background Art

There is a need for a simple, inexpensive, practical device to maintain the separable elements of an extension cord coupling against inadvertent separation. Frequently, the electrical cords of typical electrical equipment such as vacuum cleaners, hedge trimmers, industrial machinery such as hand drills, extension lights and the like, must be coupled to an extension cord to reach their desired location of use. The inherent strength of the coupling brought about by the friction between the prongs of one plug on the first cord and their corresponding receptacle on the second cord generally will not hold anything but the most moderate separating tension. This property is built into common household cords.

One solution to this has been the use of "twist-lock" connectors. These find acceptance in heavy-duty industrial and theatrical settings. "Twist-lock" connectors employ special prongs and receptors which are not compatible with normal home or light industrial wall plugs or with the connectors on normal extension cords. Accordingly, this solution, while effective in an industrial setting, does not work in many more common applications.

An alternative solution to the problem of cord separation has been to equip the connection with an appliance or accessory which holds the two ends of the connection in engagement. U.S. Pat. No. 3,383,639 to Anderson et al. shows a clamp device which fits around the two ends of a connection and holds the two connector halves in connection. Although this device has the advantage of being easy to use, it requires complete removal when the plugs are separated.

U.S. Pat. No. 3,014,194 to Berglund shows a cable connector protector which is a single body which clamps around the connected plug.

U.S. Pat. No. 3,030,601 to Krebs shows a very simple device which is a one-piece jacket formed of a rubber-like material which slips around the plugged-together cables.

U.S. Pat. No. 4,169,643 to Gallagher shows a mating clip wherein the connected ends of the receptacle and plug are latched within a closable container.

U.S. Pat. No. 4,643,505 to House, et al. shows a similar device in which a latched-together connector is clamped within a housing to secure its connection.

U.S. Pat. No. 4,690,476 to Morgenrath discloses an electrical connector securing system where each end of the coupling is equipped with a housing and the two housings are held together by straps.

U.S. Pat. No. 4,784,612 to Ryan discloses a pair of housings, one on each half of the connector, which thread together to secure the connector halves in a connected state.

All of these references suggest that there is a need for a good, efficient, inexpensive device for positively locking together electrical cords to prevent their uncoupling during use. Ideally, the device should be easy to engage and disengage while assuring the integrity of the connection when engaged. Also it is desirable if the locking device remains connected with the cord ends to prevent its accidental loss when not in use. Accordingly, it is an object of this invention to provide a simple and inexpensive device for securing together a pair of electrical plugs and to overcome the disadvantages associated with known devices of this type.

STATEMENT OF THE INVENTION

In one broad aspect, this invention provides a device for holding together a male plug and a female plug of an electrical connector in a connected state, each of the male and female plugs having an electrical cord extending therefrom. This device is made up of male and female members of substantially cylindrical hollow configuration. Each of these members is adapted to surround and accommodate one of the male or female plugs of the electrical connector. Each of these members is generally made of a plastic material and has a circular open end through which an accommodated plug can be accessed and a substantially closed end which has a small hole through which the electrical cord connected to the male or female plug extends. The large open end through which the plugs may be accessed are sized so that the cylindrical male member will fit within the cylindrical female member. One of the members, either male or female, has one or more axial slots or grooves cut on its surface facing the other member. The other member has one or more protuberances extending in the direction of the first member, said protuberances sized to fit within the slots or grooves cut in the first member. The one or more slots in the first member are characterized by having one or more notches extending circumferentially from them. These notches are perpendicular to the slots and perpendicular to the direction of engagement of the two connector members. In use, the two members are pushed together with the male fitting inside the female and with the protuberances of the one member sliding in the groove in the other member. When the two connector members have been pushed together to a point that they are clamping the plug halves in connection, then the members are rotated relative to one another so that the protuberances may access these extending channels. This locks the two members in connection. To disconnect, the two members are rotated relative to one another in the opposite direction so that the protuberances disengage the notches and can then slide down the grooves as the two members are pulled apart. With the connector disconnected, the plug halves can be disconnected as well.

DETAILED DESCRIPTION OF THE INVENTION

Brief Description of the Drawings

This invention will be further described with reference being made to the accompanying drawings wherein.

Detailed Description

Figure 1:
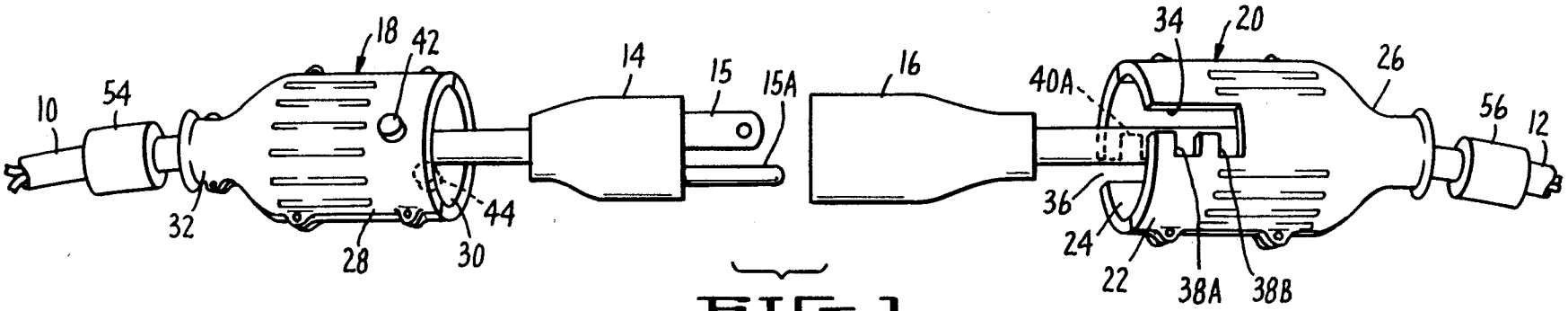
FIG. 1 is an exploded perspective view of a pair of electrical cords prior to connection, showing the two members which make up the coupling device of this invention in place on the cords prior to their engagement with one another.
Figure 2:
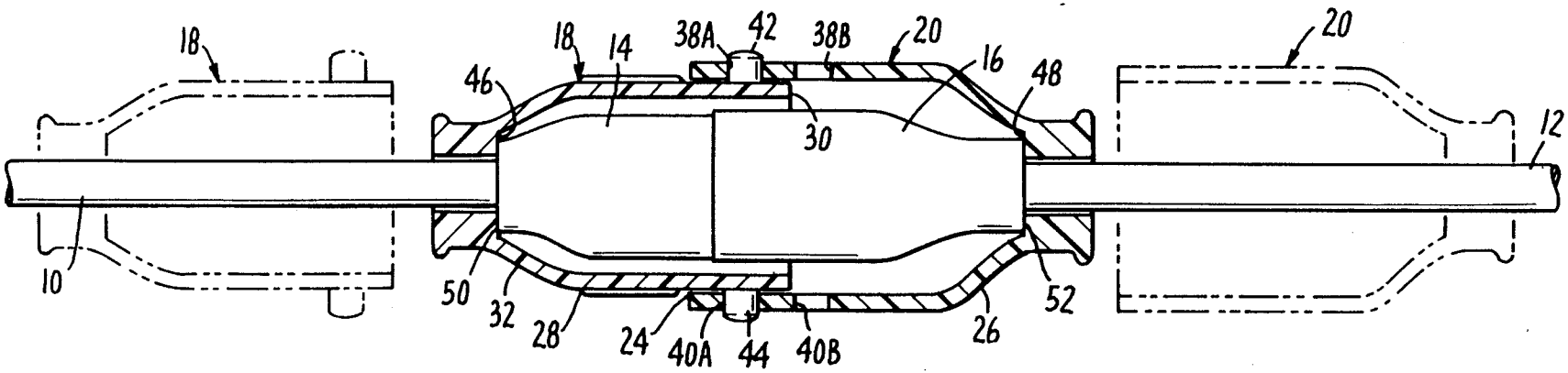
FIG. 2 is a cross-sectional view of the cords and connector members shown in FIG. 1 now in a connected state, illustrating the engagement between the two members of the accessory to lock the electrical connection.

Referring now to the drawings, wherein like reference characters designate like or corresponding parts throughout the several views, FIGS. 1 and 2 illustrate a pair of extension cords 10 and 12 having a male plug 14 on cord 10 and a female plug 16 on cord 12. In a typical application, the male plug 14 includes protruding conductors 15 and 15A commonly having a spade or rod-like shape. The protruding conductors 15 and 15A of the male plug 14 are inserted in the female plug 16 and a conductor within the female plug 16 is urged into contact with each conductor of the male plug 14. FIG. 1 illustrates the accessory of the present invention as male member 18 and female member 20 coupled about the respective cord ends.

Female member 20 has a generally cylindrical body which presents an open end 24 and a tapered enclosed end 26. Tapered enclosed end 26 has a small opening distal to the open end 24 which small opening is large enough to permit the cord of extension cord 12 to pass through but small enough to prevent the body of plug 16 from passing through. Thus, this member is retained on the cord even when not in use and is not easily lost when not in use. Open end 24 gives access to a cylindrical cavity having an internal diameter. This internal diameter is large enough for plug end 16 to nestle within it. This internal diameter of female member 20 is also related to the exterior diameter of male member 18. Male member 18 has a cylindrical body 28 having an open end 30 and a tapered enclosed end 32. End 32 also contains a small central hole through which cord 10 can pass but which will retain plug 14. This assures that this member is retained even when not in use. The large open end of male connector member 18 has an internal diameter large enough to accommodate plug 14 and an exterior diameter small enough to fit within the internal diameter of connector 20. The cylindrical wall of female member 20 contains two slots 34 and 36 which are parallel to one another and which run generally axially from open end 24 back towards enclosed end 26. Each of these slots 34 and 36 has several notches extending off from it. These notches are shown as 38A and 38B and 40A and 40B, respectively. In the embodiment shown, the slots and notches are cut all the way through the wall of connector member 20. In other embodiments these slots need not go all the way through the wall, but rather could be indentions on the internal surface of connector member 20.

Male connector member 18 has two protuberances 42 and 44 sticking out from its exterior surface. These are sized and positioned to fit into slots 34 and 36 on female connector member 20. When the two connector members 18 and 20 are pushed together the protuberances 42 and 44 can enter slots 34 and 36. The notches 38A, 38B, 40A, and 40B are sized to also receive the protuberances 42 and 44. Thus, after the connector members 18 and 20 are slid together with the protuberances 42 and 44 sliding along slots 34 and 36 until they are adjacent to either notches 38A and 40A or 38B and 40B the two members may be rotated relative to one another and the protuberances latched into the notches to which they are adjacent. By this latching the two connectors are held together and resist separation by end to end pulling. This coupling may be clearly seen by reference to FIG. 2 where pegs 42 and 44 are seen engaging notches 40A and 38A.

As can also be seen with reference to FIG. 2, the inner surfaces of the enclosed ends of connector members 18 and 20 have shoulders 46 and 48 respectively which abut the ends 50 and 52 of plugs 14 and 16. Depending upon the size of plugs 14 and 16 the connector members 18 and 20 may be moved closer together so that pegs 42 and 44 engage slots 38B and 40B respectively in the case of a smaller plug.

The two connector members 18 and 20 are free to move along cords 10 and 12. As shown in FIGS. 1 and 2, this movement of connector members 18 and 20 along cords 10 and 12 permits plug ends 12 and 14 to completely protrude from members 18 and 20 so as to permit plug ends 12 and 14 to be grasped by the user and manually connected and disconnected. To keep the two connector members near the plug ends to which they relate, simple retainer clips or collars 54 and 56 may be fastened around wires 10 and 12 so as to prevent the connector members 18 and 20 from slipping far down the cords.

Figure 4:
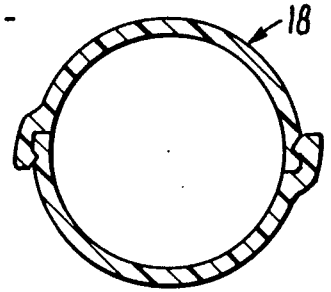
FIGS. 3 and 4 are end views of connector members of the invention taken from their large open ends which illustrate two alternative embodiments for fastening each of the members about their respective plugs.
Figure 3:
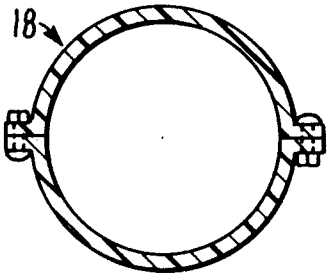

The connector members 18 and 20 surround and enclose the ends of cords 10 and 12 and their plug ends 14 and 16. To achieve this surrounding, the connectors may be fabricated in two pieces. In FIGS. 3 and 4, two end views taken from the large ends of a connector 18 are shown. The wall of the connector 28 is defined by two coupled together pieces. As shown in FIGS. 3 and 4, these two pieces can operate in a clamshell like manner and are fastened around the ends of their cords. In the case of FIG. 3, these two halves are held together with screws and in FIG. 4 they latch together by friction engagement. Alternatively one could use a single piece which is latched on one side and has a hinge on the other.

It will be appreciated that the device of this invention can be modified from the embodiment just described. For example, the location of the slots and notches on the female member and the protuberances on the male member could be reversed. Instead of two slots, one, three, or more slots could be used. Instead of two notches on each slot, one, three or more could be present. In addition to these specific changes, other modifications could be made to this invention which would not depart from the spirit of the invention as defined by the following claims.

What is claimed is:

1. A device for holding together a male plug and a female plug of an electrical connector in a connected state, each of the male and female plugs having a plug body and an electrical cord extending therefrom, said device comprising:

male and female members of substantially cylindrical hollow configuration, each of the member having an open end adapted to receive one of the male and the female plugs and enclose and surround said one of the male and female plugs while presenting an open end through which the surrounded male or female plug can fully protrude and be accessed and an enclosed end shaped to engage and abut its inner surface against the body of the plug it surrounds and to provide an aperture through which the electrical cord can extend and move so as to permit the male or female plug to move relative to the member and to fully protrude from the member and be grasped for connection and disconnection;

the male hollow member having an exterior cylindrical surface which fits within the interior cylindrical surface of the female hollow member, one of the two cylindrical surfaces carrying one or more axial indentations each having one more indented notches in communication with and perpendicular to the axial indentations, the other of the two cylindrical surfaces carrying one or more protuberances, the number, size and location of the protuberances corresponding to the axial indentations on the other surface, said protuberances positioned so as to engage the axial indentations and to meet the perpendicular notches when the inner surfaces of the male and female members abut against the bodies of the male and female plugs in a connected state so that upon rotation of the male and female members relative to one another, the protuberances enter and engage the notches thereby locking the two members in position holding together the male plug and the female plug in a connected state.

2. The device of claim 1 wherein the number of indentations is two and the number of notches extending from the indentations is two or more.

3. The device of claim 1 wherein the indentations and notches are present on the female member and the protuberances are present on the male member.

4. The device of claim 1 wherein the indentations and notches are present on the male member and the protuberances are present on the female member.

5. The device of claim 1 in combination with a pair of retaining means, one of the retaining means on each of the two cords, said retaining means positioned adjacent to the male and female members so as to permit their movement along the cord away from the male and female pugs to a distance adequate to permit the plugs to fully protrude and be grasped but so as to prevent their movement along the cord substantially away from the male and female plugs.

* * * * *